US007119502B2

(12) United States Patent
Maishima

(10) Patent No.: US 7,119,502 B2
(45) Date of Patent: Oct. 10, 2006

(54) FLASHING DISCHARGE TUBE-USE POWER SUPPLY AND CONTROL METHOD THEREFOR

(75) Inventor: Mitsuyoshi Maishima, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 23 days.

(21) Appl. No.: 10/494,206

(22) PCT Filed: Oct. 30, 2002

(86) PCT No.: PCT/JP02/11302

§ 371 (c)(1),
(2), (4) Date: Apr. 29, 2004

(87) PCT Pub. No.: WO03/039210

PCT Pub. Date: May 8, 2003

(65) Prior Publication Data

US 2004/0251851 A1 Dec. 16, 2004

(30) Foreign Application Priority Data

Oct. 31, 2001 (JP) ..... 2001-335398

(51) Int. Cl.
*G05F 1/00* (2006.01)
*H05B 37/02* (2006.01)
*H05B 39/04* (2006.01)
*H05B 41/36* (2006.01)

(52) U.S. Cl. ..... 315/308; 315/360; 315/DIG. 7

(58) Field of Classification Search ..... 315/308, 315/56, 70, 72, 86, 199, 299, 302, 341, 349, 315/360, 361, DIG. 7

See application file for complete search history.

(56) References Cited

U.S. PATENT DOCUMENTS

| | | | | |
|---|---|---|---|---|
| 4,444,483 | A * | 4/1984 | Nakajima | 396/206 |
| 4,522,479 | A * | 6/1985 | Yamada et al. | 396/201 |
| 4,656,397 | A * | 4/1987 | Chappell et al. | 315/241 S |
| 5,083,062 | A * | 1/1992 | Ichihara | 315/241 P |
| 5,093,681 | A * | 3/1992 | Matsuzaki et al. | 396/163 |
| 6,147,460 | A * | 11/2000 | Ichihara | 315/241 P |
| 6,453,145 | B1 * | 9/2002 | Miura | 399/336 |

FOREIGN PATENT DOCUMENTS

| | | |
|---|---|---|
| JP | 01-314230 | 12/1989 |
| JP | 06-7107 | 1/1994 |
| JP | 07-168260 | 7/1995 |
| JP | 11-237668 | 8/1999 |

* cited by examiner

*Primary Examiner*—Don Wong
*Assistant Examiner*—Marie Antoinette Cabucos
(74) *Attorney, Agent, or Firm*—Drinker Biddle & Reath LLP

(57) ABSTRACT

A voltage for light emission is applied to the positive electrode 11 and negative electrode 13 of a flash discharge tube 3 (xenon flash lamp) by a charge and discharge capacitor 17. When the voltage of the charge and discharge capacitor 17 does not reach a predetermined value, for example a voltage normally required for light emission operation of the flash discharge tube until a predetermined, for example, a time normally required to charge the charge and discharge capacitor 17, a timer circuit 39 generates a charging stop signal S3. A control circuit 35 controls to turn off the switch of a power supply 33 with reference to the signal S3 to stop the charging to the charge and discharge capacitor 17.

3 Claims, 3 Drawing Sheets

FLASHING DISCHARGE TUBE-USE POWER SUPPLY AND CONTROL METHOD THEREFOR

TECHNICAL FIELD

The present invention relates to a power supply portion for a flash discharge tube to fire a flash discharge tube such as a xenon flash lamp, and a control method thereof.

BACKGROUND ART

A flash discharge tube, typified by a xenon flash lamp, is widely used as a light source for spectroscopic analysis, a light source for a flash lamp of a camera, a lamp for a high-speed shutter camera or the like because the spectral characteristics of the output light thereof are approximate to sunlight and it can provide stable flash light having a very short light-emission duration. Rare gas such as xenon or the like is filled in such a flash discharge tube. By applying high-voltage pulse current to a trigger electrode disposed in the discharge tube, electrical breakdown is partially induced to form a route through which current flows, and main discharging charges flow from a negative electrode to a positive electrode along this route, so that ionized rare gas induces arc luminescence and light is emitted to the outside. Here, a large current is required to be instantaneously supplied for the main discharge, and thus there is normally adopted such a method that a required amount of electricity is charged in a capacitor for the main discharge in advance, and current is supplied from the main discharging capacitor at the light emission time.

DISCLOSURE OF THE INVENTION

In order to realize a flash discharge apparatus having a short light emission interval and strong light intensity (bright), it is required to increase the capacity of a main discharge capacitor and shorten the charge time. In order to increase the capacity of the main discharge capacitor and shorten the charge time as described above, it is preferable to charge large and constant current.

However, when a short circuit, a continuous electrical breakdown state in a discharge tube or the like occurs due to failure in a power supply system or the discharge tube, discharging from the capacitor is continued and the charging operation is continued, which may damage diodes or a transformer in the power supply system.

Therefore, the present invention has an object to provide a power supply portion for a flash discharge tube which can effectively suppress damage of the power supply portion as described above, and a control method thereof.

In order to achieve the above object, a power supply portion for a flash discharge tube according to the present invention comprises: a charge and discharge capacitor which is electrically connected to a DC constant power supply and the positive electrode and negative electrode of a flash discharge tube, accumulates charges supplied from the DC constant power supply and supplies the charges to the negative electrode of the flash discharge tube to make the flash discharge tube emit light; charging monitoring means for monitoring a time required for charging and a charging voltage during a charging operation to the charge and discharge capacitor; and charging stopping control means for stopping the charging operation to the charge and discharge capacitor with reference to the monitoring result of the charging monitoring means. On the other hand, the method of controlling a power supply portion for a flash discharge tube according to the present invention monitors a charge time and a charging voltage when a charge and discharge capacitor for supplying charges to make the flash discharge tube carry out arc light emission is charged, and stops the charging operation to the charge and discharge capacitor with reference to the monitoring result.

When short-circuiting of the power supply portion for the flash discharge tube or the like occurs, discharging from the charge and discharge capacitor is continued even during charging of the charge and discharge capacitor, and thus the charging requires a longer time than when no short-circuiting occurs. According to the power supply portion for the flash discharge tube and the control method of the present invention, the charge time and the charging voltage are monitored. Therefore, when the charging requires a long time as described above (specifically, when the voltage does not reach a predetermined voltage even when a predetermined time has passed, when the charge amount or charging speed within a predetermined time is not more than a predetermined value, when a time required to achieve a predetermined voltage is more than a predetermined time, etc.), the charging to the charge and discharge capacitor is stopped, whereby current can be prevented from continuously flowing through the charge and discharge capacitor and thus the other components of the power supply portion for the flash discharge tube.

It is preferable to comprise a transformer controlled by the charging stop control means between the DC constant power supply and the charge and discharge capacitor. When the flash discharge tube is made to emit light with large power, the power supply portion for the flash discharge tube is required to charge the charge and discharge capacitor with a high voltage (large current). In this case, by using the transformer, the charge and discharge capacitor can be quickly charged without using any high-voltage power supply. When an abnormality occurs, the operation of the transformer is stopped to prevent large current from continuously flowing into the coil of the transformer.

BEST MODES FOR CARRYING OUT THE INVENTION

Figure 1:
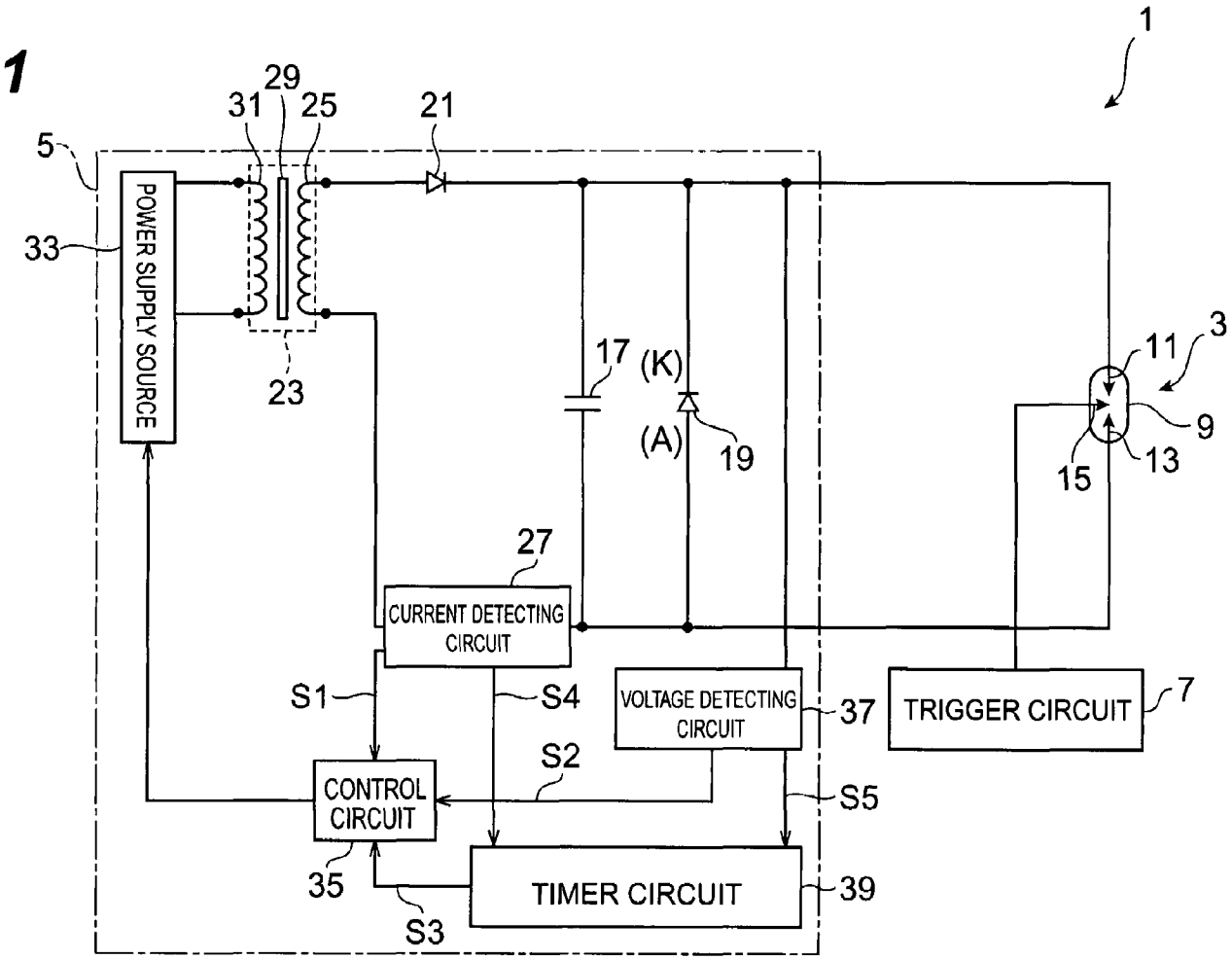
FIG. 1 is a block diagram showing the construction of a flash discharge tube apparatus containing a power supply portion for a flash discharge tube according to a present embodiment.

A preferred embodiment according to the present invention will be hereunder described in detail with reference to the accompanying drawings. To facilitate the comprehension of the explanation, the same reference numerals denote the same parts, where possible, throughout the drawings, and a repeated explanation will be omitted.

FIG. 1 is a block diagram showing the construction of a flash discharge tube apparatus 1 containing a power supply portion for a flash discharge tube according to the present embodiment. This flash discharge tube apparatus 1 comprises of a flash discharge tube 3 for carrying out arc light emission, a flash discharge tube power supply portion 5 for generating a voltage to be applied to the positive electrode and negative electrode of the flash discharge tube 3, and a light emission trigger circuit 7 for generating a trigger voltage to be applied to a trigger electrode of the flash discharge tube 3. The flash discharge tube 3 is a xenon flash lamp, for example. The flash discharge tube 3 comprises of a cylindrical glass container 9, and a positive electrode 11, a negative electrode 13 and a trigger electrode 15 disposed in the container 9. Xenon gas is filled in the glass container 9.

The trigger electrode 15 of the flash discharge tube 3 is connected to the light emission trigger circuit 7. A high-voltage trigger voltage is applied to the trigger electrode 15 when the flash discharge tube 3 is made to emit light by the light emission trigger circuit 7.

A charge and discharge capacitor 17 and a surge current diode 19 are connected to the positive electrode 11 and negative electrode 13 of the flash discharge tube 3, respectively in parallel. By discharging the charge and discharge capacitor 17, the charges accumulated in the charge and discharge capacitor 17 are supplied to the flash discharge tube 3, and the flash discharge tube 3 emits light by the arc light emission formed by the charges thus supplied. The flash discharge tube 3, the charge and discharge capacitor 17 and the surge current diode 19 are mutually connected to one another through electric cables or wires on a printed board. The cathode K of the surge current diode 19 is connected to the positive electrode 11 of the flash discharge tube 3, and the anode A thereof is connected to the negative electrode 13 of the flash discharge tube 3. When the wire between the flash discharge tube 3 and the charge and discharge capacitor 17 is long, the residual inductance at this wire portion is increased, and a part of energy supplied from the charge and discharge capacitor 17 at light emission time is accumulated. This energy flows through the circuit comprising the flash discharge tube 3 and the surge current diode 19 and is consumed.

The cathode of the rectifier diode 21 is connected to the electrode of the charge and discharge capacitor 17 which is connected to the positive electrode 11 of the flash discharge tube 3, and the anode of the rectifier diode 21 is connected to one end of a secondary coil 25 constituting the transformer 23 of the flash discharge tube power supply 5. The other end of the secondary coil 25 is connected to the electrode which is connected to the negative electrode 13 of the flash discharge tube 3 of the charge and discharge capacitor 17 through a current detecting circuit 27 for detecting current flowing in the secondary coil 25.

The secondary coil 25 of the transformer 23 is electromagnetically connected to the primary coil 31 through the core 29, and the primary coil 31 is connected to a power supply 33. As described above, the charge and discharge capacitor 17 is charged by a high voltage generated in the transformer 23, whereby charges can be quickly accumulated even when a large-capacity charge and discharge capacitor 17 is used, and the flash discharge tube 3 can be made to emit light with large power such as 150 watts, for example. The switch of the power supply 33 is turned on to make current flow into the primary coil 31, thereby generating a high voltage in the secondary coil 25, so that large current to charge the charge and discharge capacitor 17 can be supplied. Furthermore, the switch of the power supply source 33 is turned off to stop the current flow into the primary coil 31, whereby the current supply to charge the charge and discharge capacitor 17 can be stopped.

The on/off operation of the switch in the power supply 33 is controlled by a control circuit 35 (charging stop control means) of the power supply portion 5 for the flash discharge tube 5. A current detection signal S1 output from the current detecting circuit 27 is input into the control circuit 35. The control circuit 35 controls the on/off operation of the power supply 33 with reference to the signal S1 so that the charge current of the charge and discharge capacitor 17 is equal to a fixed value, thereby charging the charge and discharge capacitor 17 with constant current.

A voltage signal S2 from a voltage detecting circuit 37 connected to the positive electrode 11 of the flash discharge tube 3 is also input into the control circuit 35. The voltage detecting circuit 37 detects the voltage applied to the positive electrode 11 (the voltage of the charge and discharge capacitor 17). When the voltage of the positive electrode 11 (the charge and discharge capacitor 17) of the flash discharge tube 3 reaches a predetermined value, for example, a voltage normally required for light emission operation of the flash discharge tube 3, the voltage signal S2 is output from the voltage detecting circuit 37. Upon input of the voltage signal S2, the control circuit 35 turns off the switch of the power supply source 33 to stop the charging of the charge and discharge capacitor 17, whereby the charge and discharge capacitor 17 is charged so that the normally-required voltage is fixed at all times.

The voltage detecting circuit 37 contains an overvoltage detecting circuit. When an excessive voltage is applied to the positive electrode 11 (the charge and discharge capacitor 17) of the flash discharge tube 3 due to some abnormality, the voltage signal S2 is output from the voltage detecting circuit 37, and the charging of the charge and discharge capacitor 17 is stopped in the same manner as described above, thereby preventing failure, breakdown, etc., of the charge and discharge capacitor 17, the flash discharge tube 3, etc., by the overvoltage.

A charging stop signal S3 from a timer circuit 39 (charging monitoring means) is input into the control circuit 35. When the voltage of the charge and discharge capacitor 17 does not reach a predetermined value, for example, a normal voltage normally required for light emission operation of the flash discharge tube 3 (that is, the voltage required for normal light emission operation of the flash discharge tube 3) although the time has passed normally required for the charging of the charge and discharge capacitor 17 (that is, the time required to charge the charge and discharge capacitor 17 in normal light emission operation of the flash discharge tube 3), the timer circuit 39 outputs the charging stop signal S3. Upon input of the signal S3 into the control circuit 35, the control circuit 35 turns off the switch of the power supply 33 to stop the charging to the charge and discharge capacitor 17. Accordingly, when the voltage of the charge and discharge capacitor 17 does not reach the normal voltage described above due to short-circuiting or the like, burnout of the transformer 23, etc., which are caused by the continuous current flow through the transformer 23 can be prevented.

A charge current detection signal S4 from the current detecting circuit 27 is input to the timer circuit 39. The current for charging the charge and discharge capacitor 17 flows into the secondary coil 25 of the transformer 23, whereby the current detecting circuit 27 generates the charge current detection signal S4. The signal S4 is input into the timer circuit 39, whereby the timer circuit 39 measures the charge time. A charging end signal S5 from the voltage detecting circuit 37 is also input into the timer circuit 39. The signal S5 is generated from the voltage detecting circuit 37 when the voltage of the charge and discharge capacitor 17 reaches a predetermined value, that is, the voltage normally required for light emission operation of the flash discharge tube 3 in the above case. Upon input of the signal S5 into the timer circuit 39, the operation of the timer circuit 39 is stopped. However, the off-operation of the power supply 33 is not carried out. Here, in the above case, when the voltage of the charge and discharge capacitor 17 does not reach the voltage normally required for light emission operation of the flash discharge tube 3 although the time reaches a predetermined time longer than the time normally required to charge the charge and discharge capacitor 17, the charge stop signal S3 is generated from the timer circuit 39 prior to the signal S5, and the signal S3 is input into the control circuit 35, whereby the control circuit 35 turns off the switch of the power supply 33 to finish the charging to the charge and discharge capacitor 17. The control method of the flash discharge tube power supply portion 5 using the charge stop signal S3, the charge current detection signal S4 and the charge end signal S5 is one of the features of the control method of the flash discharge tube power supply portions according to this embodiment.

Figure 2:
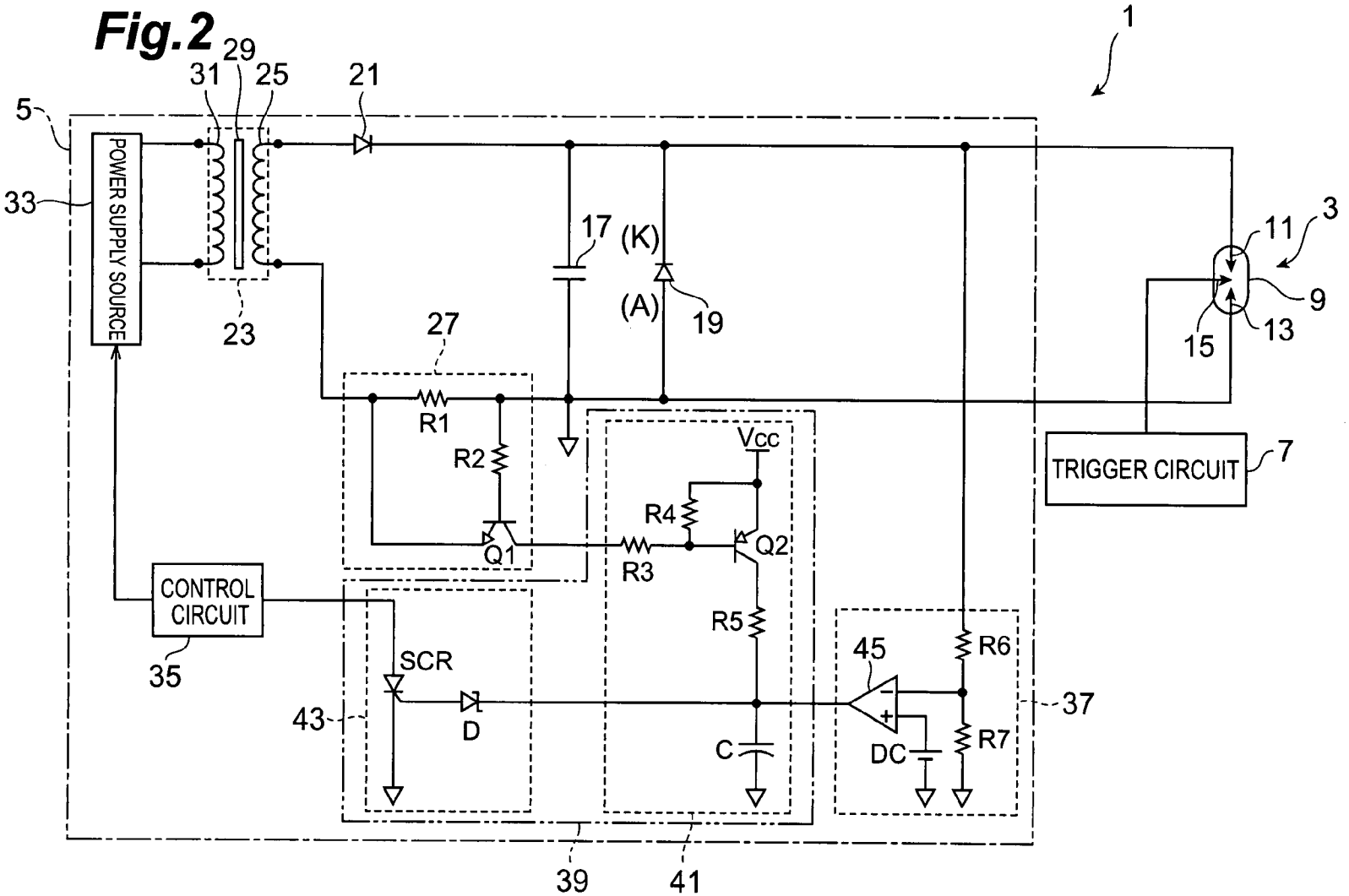
FIG. 2 is a circuit diagram showing the power supply portion.

Next, the circuit constructions of the timer circuit 39, the current detecting circuit 27 and the voltage detecting circuit 37 which generate the signals S3, S4, S5 respectively will be described. FIG. 2 is a circuit diagram showing the flash discharge tube power supply portion 5 according to this embodiment, and the circuit constructions of the current detecting circuit 27, the timer circuit 39 and the voltage detecting circuit 37 will be described with reference to FIG. 2.

First, the circuit construction of the current detecting circuit 27 will be described. A current detecting resistor R1 of the current detecting circuit 27 is an element for detecting current flowing in the secondary coil 25 of the transformer 23, and it is connected to the series circuit comprising the secondary coil 25 and the charge and discharge capacitor 17. One end of a current limiting resistor R2 is connected between the current detecting resistor R1 and the charge and discharge capacitor 17, and the other end of the current limiting resistor R2 is connected to the base of an NPN transistor Q1 of the current detecting circuit 27. The base current of the transistor Q1 is prevented from excessively increasing by the current limiting resistor R2. The emitter of the transistor Q1 is connected between the current detecting resistor R1 and the secondary coil 25. The collector of the transistor Q1 is connected to the timer circuit 39.

Next, the circuit construction of the timer circuit 39 will be described. The timer circuit 39 is charged linked with the charging of the charge and discharge capacitor 17, and it comprises a charge and discharge circuit 41 (time measuring means) which is discharged upon stop of the charging of the charge and discharge capacitor 17, and a latch circuit 43 (signal generating means) for generating the charge stop signal S3. The collector of the transistor Q1 is connected to the base of a PNP transistor Q2 of the charge and discharge circuit 41 through a current limiting resistor R3 of the charge and discharge circuit 41. The base current of the transistor Q2 is prevented from excessively increasing by the current limiting resistor R3.

The emitter of the transistor Q2 is connected to a power supply source VCC and also connected to one end of a resistor R4 for OFF, and the other end of the resistor R4 for OFF is connected between the current limiting resistor R3 and the base of the transistor Q2. At the off-operation time of the transistor Q2, the off-operation of the transistor Q2 is made quick by reducing the base current of the transistor Q2 with the resistor R4 for OFF.

The collector of the transistor Q2 is connected to one electrode of a charge time measuring capacitor C through a time constant adjusting resistor R5, and the other electrode of the capacitor C is grounded. The charging of the capacitor C is started by the start of the charging of the charge and discharge capacitor 17 and also it can be charged for a predetermined time longer than the time normally required to charge the charge and discharge capacitor 17. The predetermined time is a time which is required to reach a latch voltage at which the latch circuit 43 is operated. The time constant of the charge and discharge circuit, 41 is set so that at normal light emission operation of the flash discharge tube 3, the charging of the charge and discharge capacitor 17 is completed before the voltage of the capacitor C reaches the latch voltage. The time constant of the charge and discharge circuit 41 is adjusted by the time constant adjusting resistor R5.

The cathode of a switch diode D (zener diode) is connected between the resistor R5 and the capacitor C. The anode of the switch diode D is connected to the gate of a switching element SCR (thyristor) of the latch circuit 43. When the voltage of the charge time measuring capacitor C reaches the latch voltage, the switch diode D is turned on and current flows. The cathode of the switching element SCR is grounded, and the anode thereof is connected to the control circuit 35. When the switch diode D is turned on by the latch voltage, current flows through the gate of the switching element SCR, and the switching element SCR is turned on, so that the charge stop signal S3 is output. Next, the voltage detecting circuit 37 will be described. The inverted input terminal of a comparator 45 of the voltage detecting circuit 37 is connected between a resistor R6 and a resistor R7. The resistor R6 is connected to the positive electrode 11 of the flash discharge tube 3, and the resistor R7 is grounded. The plus of a DC power supply DC (reference voltage) is connected to the non-inverted input terminal of the comparator 45, and the minus of the DC power supply DC is grounded. The output terminal of the comparator 45 is connected between the time constant adjusting resistor R5 of the charge and discharge circuit 41 and the charge time measuring capacitor C.

The comparator 45 is a differential type amplifying circuit, and compares the reference voltage value input into the non-inverted input terminal thereof with a divisional value of the voltage of the charge and discharge capacitor 17 (the voltage of the positive electrode 11) which is divided by the resistors R6 and R7 and input into the inverted input terminal. The output of the comparator 45 is inverted when the voltage of the charge and discharge capacitor 17 reaches the voltage normally required for light emission operation of the flash discharge tube 3, whereby the charge time measuring capacitor C is discharged and thus the voltage of the capacitor C does not reach the latch voltage. That is, when the charge and discharge capacitor 17 is charged within the normally required time, the operation of the timer circuit 39 is stopped, however, the power supply 33 continues its normal operation. A circuit for controlling the voltage of the charge and discharge capacitor 17 and a circuit for detecting excessive increase of the voltage of the charge and discharge capacitor 17 when the voltage of the charge and discharge capacitor 17 increases excessively are omitted from illustration.

Figures 3A, 3B, 3C:
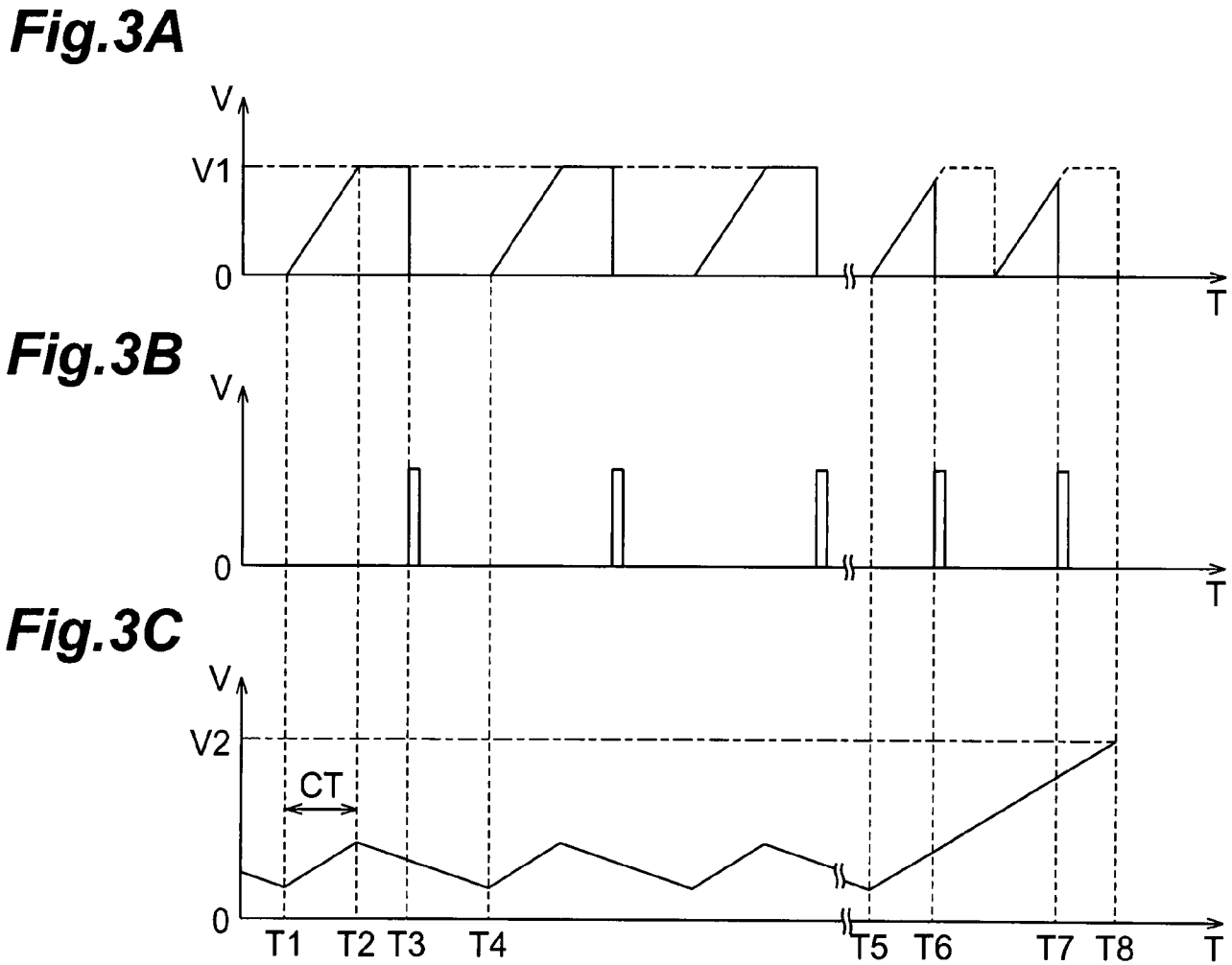
FIGS. 3A to 3C are time charts showing the operation of the apparatus of FIG. 1, and represent a voltage applied to the positive electrode of the flash discharge tube, a voltage applied to a trigger electrode and the time-variation of a voltage of a charge time measuring capacitor C of a charge and discharge circuit, respectively.

Next, the operation of the flash discharge tube apparatus 1 containing the flash discharge tube power supply portion 5 according to this embodiment will be described with reference to FIG. 1, FIG. 2, FIG. 3A to FIG. 3C. FIG. 3A to FIG. 3C are time charts on the operation of the flash discharge tube apparatus 1, wherein FIG. 3A shows the variation of a voltage applied to the positive electrode 11 of the flash discharge tube 3, FIG. 3B shows the variation of a voltage applied to the trigger electrode 15, and FIG. 3C shows the variation of the voltage of the charge time measuring capacitor C of the charge and discharge circuit 41.

First, at a time T1, the control circuit 35 turns on the switch of the power supply 33 to generate a high voltage in the transformer 23 and start charging of the charge and discharge capacitor 17. In connection with this, current flowing in the secondary coil 25 of the transformer 23 flows into the current detecting resistor R1, and thus a voltage drop occurs in the current detecting resistor R1. The voltage drop makes the base current flow into the transistor Q1, and the transistor Q1 is turned on, so that the collector current flows from the transistor Q1. The collector current serves as the base current of the transistor Q2, and the transistor Q2 is turned on. Accordingly, the collector current flows from the transistor Q2 into the charge time measuring capacitor C, and the charging of the capacitor C is started. The start of the charging is the start of measurement of the charge time of the charge and discharge capacitor 17.

At a time T2, the charge and discharge capacitor 17 has been charged up to a normal voltage (V1) which is a voltage normally required for light emission operation of the flash discharge tube 3. In connection with this, the voltage of the anode 11 of the flash discharge tube 3 likewise reaches the voltage (V1). The time CT of T2–T1 corresponds to the time normally required to charge the charge and discharge capacitor 17. When the charge and discharge capacitor 17 has been charged up to the voltage (V1), the output of the comparator 45 of the voltage detecting circuit 37 is inverted, and the capacitor C is discharged by the inverted voltage from the output terminal of the comparator 45, so that the voltage of the capacitor C does not reach the latch voltage. Furthermore, the control circuit 35 turns off the switch of the power supply 33 by the signal S2 generated in the voltage detecting circuit 37 of another system to finish the charging of the charge and discharge capacitor 17.

When the charging of the charge and discharge capacitor 17 is finished, no current flows in the current detecting resistor R1 of the current detecting circuit 27, and thus no base current flows in the transistor Q1, so that the transistor Q1 is turned off. Accordingly, no base current flows in the transistor Q2 flow, and thus the transistor Q2 is turned off, so that the charging of the charge time measuring capacitor C is stopped. That is, when the voltage of the charge and discharge capacitor 17 reaches the voltage V1 normally required for light emission operation of the flash discharge tube 3 before a predetermined time longer than the time CT normally required to charge the charge and discharge capacitor 17 has passed, the measurement of the charge time is stopped.

Subsequently, at a time T3, that is, after a predetermined time has passed from the time T corresponding to the charging end time of the charge and discharge capacitor 17, a trigger voltage is applied to the trigger electrode 15 by the light emission trigger circuit 7 as shown in FIG. 3B, so that xenon gas in the flash discharge tube 3 suffers electrical breakdown. Therefore, the charges accumulated in the charge and discharge capacitor 17 are supplied to the flash discharge tube 3, and the flash discharge tube 3 emits light (carries out arc light emission). The above is one cycle of the light emission, and the light emission operation is subsequently repeated in the same manner.

The charging of the charge and discharge capacitor 17 is stopped during the period from the time T2 to the charging start time T4 of the charge and discharge capacitor 17 in the next light emission cycle, and thus no current flows in the current detecting resistor R1 of the current detecting circuit 27. Accordingly, the charging of the charge time measuring capacitor C is also stopped (that is, the measurement of the charting time is stopped), and the charting time measuring capacitor C is discharged through the comparator 45 and is spontaneously discharged. Therefore, reduction of the voltage of the charge time measuring capacitor C starts as shown in the time chart (C). Thereafter, at the charging start time T4 of the next light emission cycle, current flows into the current detecting resistor R1, and thus the voltage of the charge time measuring capacitor C is increased again.

The above operation is a normal light emission operation. However, when there occurs a state where the light emission frequency of the flash discharge tube 3 is increased to a nominal value or more because the frequency of a trigger signal applied to the trigger electrode 15 is increased by some abnormality, the voltage of the charge and discharge capacitor 17 does not reach the normal voltage V corresponding to the voltage normally required for light emission operation of the flash discharge tube 3 even when the time CT normally required to charge the charge and discharge capacitor 17 has passed. Therefore, if no safeguard is taken, the charge and discharge capacitor 17 is continued to be charged and supplied with a large current thus heat generation, failure or the like occurs in the flash discharge tube power supply portion 5. According to this embodiment, under such a state, the charging of the charge and discharge capacitor 17 is stopped to prevent current from continuously flowing in the transformer 23, so that burnout or failure of the transformer 23, etc., can be prevented, and thus heat generation or failure of the flash discharge tube power supply portion 5 is prevented. This will be described hereunder in detail.

It is shown in FIG. 3A to FIG. 3C that the frequency of the trigger signal applied to the trigger electrode 15 is increased by some abnormality after the time T5. As shown in FIG. 3A, the charging of the charge and discharge capacitor 17 is started from the time T5.

At a time T6, the trigger signal shown in FIG. 3B is generated before the positive electrode 11 (charge and discharge capacitor 17) reaches the voltage V1, so that the flash discharge tube 3 emits light. This is caused by the increase of the frequency of the trigger signal due to some abnormality as described above. However, no normal voltage is applied to the flash discharge tube 3 by the charge and discharge capacitor 17, and thus there occurs an abnormal light emission state where the light emission intensity is weaker than that under the normal light emission state. Since the anode 11 (charge and discharge capacitor 17) does not reach the voltage V1, the charging of the charge and discharge capacitor 17 is continued, and the voltage of the charge time measuring capacitor C is continued to increase (that is, the charge time is continued to be measured) as shown in FIG. 3C.

At a time T7, the trigger signal shown in FIG. 3B is generated again before the anode 11 (charge and discharge capacitor 17) reaches the voltage V1, and thus the flash discharge tube 3 emits light. That is, there occurs a phenomenon where the light emission frequency of the flash discharge tube 3 is abnormally quick and thus emission of weak light is continued.

At a time T8, according to this embodiment, the voltage of the charge time measuring capacitor C reaches the voltage V2 corresponding to the latch voltage as shown in FIG. 3C, and thus the charging to the charge and discharge capacitor 17 is stopped as described above. Accordingly, the current flow into the transformer 23 can be prevented from continuing, so that occurrence of burnout, failure or the like of the coils 25, and 31 of the transformer 23 or the like can be prevented and thus heat generation, failure or the like of the flash discharge tube power supply portion 5 can be prevented. Furthermore, there can be achieved such a special effect that the phenomenon where the emission of the weak light described above is continued can be prevented from continuing by stopping the charging of the charge and discharge capacitor 17. In this embodiment, the time T8 minus the time T5 corresponds to the predetermined time longer than the time CT normally required to charge the charge and discharge capacitor 17.

According to this embodiment, the following special effect can be achieved. Short-circuiting may occur in the flash discharge tube apparatus 1 due to various causes (for example, short-circuiting of the charge and discharge capacitor 17 due to fault or breakdown of the charge and discharge capacitor 17, short-circuiting between electrodes of the flash discharge tube 3 due to application of vibration to the flash discharge tube 3 or the like, short-circuiting due to some error occurring when a user of the flash discharge tube apparatus 1 handles the flash discharge tube apparatus 1). In a case where such short-circuiting occurs, the voltage of the charge and discharge capacitor 17 does not reach the normal voltage corresponding to the voltage normally required for light emission operation of the flash discharge tube 3 even when the charge and discharge capacitor 17 is charged, so that the charging of the charge and discharge capacitor 17 is continued. Accordingly, the current flow into the flash discharge tube power supply portion 5 is continued, and thus the heat generation, failure or the like occurs in the flash discharge tube power supply portion 5.

Particularly, when the charge and discharge capacitor 17 is charged so that the charge time of the charge and discharge 17 is shortened and oscillation in the flash discharge tube power supply portion 5 during charging is reduced, the charging is carried out with a constant and large current. Therefore, when the short-circuiting concerned occurs, large current continues to flow into the flash discharge tube power supply portion 5, and thus the problem of the heat generation or the like becomes critical.

Furthermore, when the flash discharge tube 3 is made to emit light with large power such as 150 watts, the flash discharge tube power supply portion 5 is required to charge the charge and discharge capacitor 17 with a high voltage in order to increase the discharge voltage of the charge and discharge capacitor 17. Therefore, the flash discharge tube power supply portion 5 has transformer 23, and charges the charge and discharge capacitor 17 with the high voltage generated by the transformer 23. When large current continues to flow into the coil of the transformer 23 due to the short-circuiting described above, burnout may occur in the coil. If the coil is designed in a large size to safeguard against such problems, it causes large-size design of the transformer, and thus large-size design of the flash discharge tube power supply portion 5.

According to this embodiment, when the voltage of the charge and discharge capacitor 17 does not reach the normal voltage V1 until the predetermined time (the time of T8 minus T5) longer than the time CT normally required to charge the charge and discharge capacitor 17 because of occurrence of the short-circuiting, the charging to the charge and discharge capacitor 17 is stopped in the same manner as the state where the light emission frequency of the flash discharge tube 3 is larger than the nominal value. Accordingly, the current flow into the transformer 23 can be prevented from continuing and thus the heat generation, failure or the like of the flash discharge tube power supply portion 5 can be prevented.

Furthermore, according to this embodiment, the following effect can also be achieved. For example, in the case of an abnormal heating state of the flash discharge tube 3, a deterioration state of the electrodes 11, 13, and 15 of the flash discharge tube 3, an abnormal heating state of the electrodes 11, 13 or an abnormal approaching state of the electrodes 11, 13, and 15 due to breakage of the flash discharge tube 3, the light emission mode of the flash discharge tube 3 is not set to a flash light emission mode (normal light emission mode), but a DC continuous discharge mode. In the DC continuous discharge mode, even when the charge and discharge capacitor 17 is charged, the voltage thereof does not reach the voltage normally required for light emission operation of the flash discharge tube 3, so that the charging to the charge and discharge capacitor 17 is continued. That is, the transformer 23 is set to an output state (current continues to flow).

In the normal light emission mode, the output time of the transformer 23 per light emission cycle is equal to a half of the light emission cycle. On the other hand, in the DC continuous discharge mode, current continues to flow into the transformer 23, and thus the output time is equal to that of the light emission cycle. That is, in the DC continuous discharge mode, the average current of the transformer 23 is excessively larger (for example, twice) than the normal light emission mode. In the DC continuous discharge mode, the luminous efficiency is reduced, and thus most of power input into the flash discharge tube 3 is changed to heat. Accordingly, when the flash discharge tube 3 is continued to be DC-discharged in the DC continuous discharge mode, the flash discharge tube 3 reach an abnormal heat state, and this causes blowout of the flash discharge tube 3 or damage of the flash discharge tube apparatus 1.

According to this embodiment, when the mode is set to the DC continuous discharge mode as described above, the charging to the charge and discharge capacitor 17 is stopped in the same manner as the operation at the time when the short-circuiting occurs. Therefore, the current flow into the transformer 23 can be prevented from continuing, and thus blowout or the like of the flash discharge tube 3 can be prevented.

In the foregoing description, the charging/discharging operation is stopped when the charging of the voltage normally required for light emission operation of the flash discharge tube 3 has not been completed although the time normally required for the charging has passed during the charging operation of the charge and discharge capacitor 17. However, the present invention is not limited to this embodiment. For example, it may be modified so that a time shorter than the above time is set as a time threshold value, a voltage which is slightly lower than a voltage chargeable within that time is set as a voltage threshold value, and the charging is stopped when the charged voltage does not reach the voltage threshold value at the point in time when the charge time reaches the time threshold value. In this case, an effect of suppressing the abnormal light emission state as described above can be achieved. Furthermore, the judgment may be made with reference to the time in which such a low set voltage is reached, and the judgment may be made with reference to the charging speed, and the charging amount.

In above case, the xenon lamp is used. However, it is a matter of course that other kinds of flash lamps (flash discharge tubes) may be used.

INDUSTRIAL APPLICABILITY

The flash discharge tube power supply portion and the control method thereof may be preferably used as a power supply portion of a flash discharge tube which is used as a light source for spectroscopic analysis, a light source for a flash lamp of a camera or a lamp for a high-speed shutter camera, and a method of controlling the flash discharge tube power supply portion.

The invention claimed is:

1. A power supply portion for a flash discharge tube comprising:

a charge and discharge capacitor, electrically connected to a DC constant power supply source and the positive electrode and negative electrode of a flash discharge tube, accumulating charges supplied from the DC constant power supply and supplying the charges to the negative electrode of the flash discharge tube to make the flash discharge tube emit light;

charging monitoring means for monitoring a time required for charging and a charging voltage during a charging operation to the charge and discharge capacitor, the charging monitoring means including a charge and discharge circuit as a time measuring means which is charged linked with the charging of the charge and discharge capacitor and which is discharged upon the stopping of the charging of the charge and discharge capacitor; and charging stopping control means for stopping the charging operation to the charge and discharge capacitor with reference to the monitoring result of the charging monitoring means, the charging stopping control means including a latch circuit as a signal generating means for generating a charge stop signal when the voltage of the charge and discharge circuit reaches a predetermined latch voltage, wherein the charge and discharge circuit includes a charge time measuring capacitor and the charge and discharge circuit charges this charge time measuring capacitor at a slower rate than the charging of the charge and discharge capacitor; and a charging circuit for charging the charge and discharge capacitor, the charging circuit including a current detecting circuit, wherein the charge and discharge circuit charges the charge time measuring capacitor via the current detecting circuit.

2. The flash discharge tube power supply portion according to claim 1, further comprising a transformer disposed between the DC constant power supply source and the charge and discharge capacitor and controlled by the charging stop control means.

3. A method of controlling a power supply portion for a flash discharge tube by monitoring a charge time and a charging voltage during a charging operation of a charge and discharge capacitor for supplying charges to make the flash discharge tube carry out arc light emission, and stopping the charging operation to the charge and discharge capacitor with reference to the monitoring result, the method including:

charging the charge and discharge capacitor via a charging circuit including a current detecting circuit;

charging a charge and discharge circuit by charging a charge time measuring capacitor included in the charge and discharge circuit, which is provided as a time measuring circuit, wherein the charging of the charge time measuring capacitor is linked with the charging of the charge and discharge capacitor, wherein the charge time measuring capacitor is charged at a slower rate than the charging of the charge and discharge capacitor, and wherein the charge and discharge circuit charges the charge time measuring capacitor via the current detecting circuit;

discharging the charge and discharge circuit upon the stopping of the charging of the charge and discharge capacitor; and generating a charge stop signal when the voltage of the charge and discharge circuit reaches a predetermined latch voltage.

* * * * *